US011146024B2

(12) United States Patent
Liong et al.

(10) Patent No.: US 11,146,024 B2
(45) Date of Patent: Oct. 12, 2021

(54) ELECTRICAL CONNECTOR

(71) Applicant: Molex, LLC, Lisle, IL (US)

(72) Inventors: Weng-Heng Liong, Jurong Town (SG); Chie-Meng Wong, Jurong Town (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/726,221

(22) Filed: Dec. 23, 2019

(65) Prior Publication Data

US 2020/0212632 A1 Jul. 2, 2020

(30) Foreign Application Priority Data

Dec. 26, 2018 (CN) ..... 201811599426.8

(51) Int. Cl.

| | |
|---|---|
| ***H01R 13/6471*** | (2011.01) |
| ***H01R 31/06*** | (2006.01) |
| ***H01R 12/71*** | (2011.01) |
| ***H01R 13/6587*** | (2011.01) |
| ***H01R 12/72*** | (2011.01) |

(52) U.S. Cl.

CPC ..... *H01R 13/6471* (2013.01); *H01R 12/716* (2013.01); *H01R 12/724* (2013.01); *H01R 13/6587* (2013.01); *H01R 31/06* (2013.01)

(58) Field of Classification Search

CPC ..... H01R 12/71; H01R 13/6597; H01R 13/6585; H01R 12/737; H01R 13/652; H01R 13/40; H01R 13/6591

See application file for complete search history.

(56) References Cited

U.S. PATENT DOCUMENTS

| | | | | |
|---|---|---|---|---|
| 7,402,077 | B2 | 7/2008 | Shindo | |
| 8,702,451 | B2 | 4/2014 | Luo et al. | |
| 8,764,464 | B2 | 7/2014 | Buck et al. | |
| 8,858,243 | B2 * | 10/2014 | Luo | H01R 13/652 439/108 |
| 9,337,585 | B1 * | 5/2016 | Yang | H01R 13/6471 |
| 9,455,530 | B2 | 9/2016 | Patel | |
| 9,583,882 | B1 | 2/2017 | Hsueh | |

(Continued)

FOREIGN PATENT DOCUMENTS

| | | | |
|---|---|---|---|
| CN | 102684020 | A | 9/2012 |
| CN | 103515792 | A | 1/2014 |
| CN | 204045854 | U | 12/2014 |

(Continued)

*Primary Examiner* — Jean F Duverne

(57) ABSTRACT

The present disclosure provides an electrical connector. The electrical connector comprises a tongue, a plurality of terminals comprising a plurality of first terminals and a plurality of second terminals and at least one common grounding member. Each terminal has a plate-shape contact portion. The terminals comprise ground terminals. The plate-shape contact portion of each first terminal is provided on a first face of the tongue. The plate-shape contact portion of each the second terminal is provided on a second face of the tongue. The common grounding member comprises a plurality of connection portions. The connection portion extends in a thickness direction and is connected to the plate-shape contact portion of the corresponding ground terminal. Therefore, it can shorten the loop inductance of the signal and shorten the return path to improve signal integrity (SI).

15 Claims, 19 Drawing Sheets

(56) References Cited

U.S. PATENT DOCUMENTS

| | | | | |
|---|---|---|---|---|
| 9,653,851 | B1 | 5/2017 | Yuan et al. | |
| 10,283,910 | B1 * | 5/2019 | Chen | H01R 4/04 |

FOREIGN PATENT DOCUMENTS

| | | | |
|---|---|---|---|
| CN | 205621919 | U | 10/2016 |
| CN | 205944625 | U | 2/2017 |
| EP | 0196977 | A2 | 10/1986 |
| TW | 201503498 | A | 1/2015 |

* cited by examiner

4

4

3

ELECTRICAL CONNECTOR

RELATED APPLICATIONS

This application claims priority to Chinese Application No. 201811599426.8 filed on Dec. 26, 2018, which is incorporated herein by reference in it's entirety.

TECHNICAL FIELD

The present disclosure relates to an electrical connector, more particularly, the present disclosure relates to an electrical connector with a tongue.

BACKGROUND

U.S. Pat. No. 9,583,882 (corresponding Chinese patent application issuance publication No. CN205621919U) discloses a grounding member. The grounding member comprises a conductive body and a plurality of extension portions extending from the conductive body. Each extension has a restriction portion on at least one side edge thereof. A main body portion of a ground terminal is fixed in an insulating body. A contact portion of the ground terminal is arranged on a surface of a tongue. The main body portion of the ground terminal is stacked with the extension portion of the grounding member and contacts the restriction portion at the side edge.

Because the grounding member is assembled from a rear end of the insulating housing, a position of the grounding member is positioned at the main body portion of the ground terminal, and the restriction portion of the grounding member contacts the main body portion of the ground terminal instead of the contact portion of the ground terminal, and is relatively far from an actual contact point after the contact portion of the ground terminal is mated.

U.S. Pat. No. 8,702,451 (corresponding Chinese patent application issuance publication No. CN202076606U; corresponding Taiwanese patent application issuance publication No. TWM419266U1) discloses a first grounding member provided at a front end of a tongue. The first grounding member is connected with a contact segment of a ground terminal via an elastic bifurcation.

The first grounding member is connected with the contact segment of the ground terminal, but the first grounding member is assembled from a front end of the tongue, and the elastic bifurcation of the first grounding member contacts a tip end of the contact portion of the ground terminal, and is still relatively far away from an actual contact point after the contact segment of the ground terminal is mated.

The above description of the "background" merely provides a background, and it is not admitted that the above description of "background" discloses the object of the present disclosure, and the above description of "background" does not constitute the background of the present disclosure, any above description of the "background" should not be considered as any part of the present disclosure.

SUMMARY

An embodiment of the present disclosure provides an electrical connector. The electrical connector comprises a housing, a plurality of terminals and at least one common grounding member. The housing comprises a base and a tongue. The tongue comprises a first face and a second face which are positioned at a thickness direction and extend in a length direction and a width direction, the tongue comprises a front edge and a rear edge in the width direction, and the rear edge connects the base. Each terminal has a plate-shape contact portion. At least some of the plurality of terminals comprise signal terminals and ground terminals. The plurality of terminals comprise a plurality of first terminals and a plurality of second terminals. A plate-shape contact portion of each first terminal is provided on the first face of the tongue. A plate-shape contact portion of each second terminal is provided on the second face of the tongue. The common grounding member is spaced from the front edge and the rear edge of the tongue and mounted on the tongue in the thickness direction, and positioned between the plate-shape contact portion of the first terminal and the plate-shape contact portion of the second terminal. The common grounding member comprises an elongated plate portion and a plurality of connection portions. The elongated plate portion extends in the length direction. The plurality of connection portions extend from the elongated plate portion in the thickness direction and connected to the plate-shape contact portion of the corresponding ground terminal.

In some embodiments, at least one of the first face and the second face of the tongue is provided with a common grounding member receiving groove receiving the common grounding member.

In some embodiments, each connection portion comprises: a pair of clamping arms configured to clamp two side edges of the plate-shape contact portion of the ground terminal in the length direction.

In some embodiments, the at least some of the plurality of terminals further comprise a signal terminal pair. The signal terminal pair and the ground terminals are alternately arranged. The electrical connector further comprises a shielding member. The shielding member is configured to be mechanically and electrically connected to the common grounding member and positioned between the plate-shape contact portions of the signal terminal pair provided on the first face of the tongue and the plate-shape contact portions of the signal terminal pair provided on the second face of the tongue.

In some embodiments, the tongue further comprises a shielding member receiving groove. The shielding member receiving groove is provided at the front edge of the tongue, extends rearwardly and is communicated with the common grounding member receiving groove.

In some embodiments, the shielding member and the elongated plate portion of the common grounding member comprise a plurality of fork pieces which are used to clamp the shielding member and the elongated plate portion of the common grounding member and do not overlap each other in the thickness direction.

An embodiment of the present disclosure provides an electrical connector. The electrical connector comprises a housing, a plurality of terminals and at least one common grounding member. The housing comprises a base and a tongue. The tongue comprises a first face and a second face which are positioned in a thickness direction and extend in a length direction and a width direction, the tongue comprises a front edge and a rear edge in the width direction, and the rear edge connects the base. Each terminal has a plate-shape contact portion, at least some of the plurality of terminals comprise signal terminals and ground terminals. The plurality of terminals comprise a plurality of first terminals and a plurality of second terminals. The plurality of first terminals are provided on the first face of the tongue. The plurality of second terminals are provided on the second face of the tongue. The common grounding member is mounted on the tongue and positioned between the plate-shape contact portion of the first terminal and the plate-shape contact portion of the second terminal. The common grounding member comprises an elongated plate portion, a plurality of first connection portions and a plurality of second connection portions. The elongated plate portion extends in the length direction. The plurality of first connection portions each extend from the elongated plate portion toward the first face of the tongue and each are connected to the plate-shape contact portion of the ground terminal of the first terminals at a first connecting position. The plurality of second connection portions each extend from the elongated plate portion toward the second face of the tongue and each are connected to the plate-shape contact portion of the ground terminal of the second terminals at a second connecting position. A contacting position of each ground terminal to be mated is positioned between the first connecting position and the second connecting position in the width direction.

In some embodiments, the common grounding member is spaced apart from the front edge and the rear edge of the tongue and mounted on the tongue in the thickness direction.

In some embodiments, the second face of the tongue is provided with a common grounding member receiving groove receiving the common grounding member.

In some embodiments, a projection of the contacting position of the ground terminal in the thickness direction to be mated is positioned within a range defined the elongated plate portion of the common grounding member.

In some embodiments, the first connection portion and the second connection portion each comprise a pair of clamping arms, the pair of clamping arms are configured to clamp two side edges of the plate-shape contact portion of the ground terminal in the length direction.

In some embodiments, the common grounding member receiving groove comprises a hole for the pair of clamping arms of the first connection portion to pass through the first face of the tongue.

In some embodiments, the at least some of the plurality of terminals further comprise a signal terminal pair, the signal terminal pair and the ground terminals are alternately arranged. The electrical connector further comprises a shielding member. The shielding member is configured to be mechanically and electrically connected to the common grounding member and positioned between the plate-shape contact portions of the signal terminal pair provided on the first face of the tongue and the plate-shape contact portions of the signal terminal pair provided on the second face of the tongue.

In some embodiments, the tongue further comprises a shielding member receiving groove. The shielding member receiving groove is provided at the front edge of the tongue, extends rearwardly and is communicated with the common grounding member receiving groove.

In some embodiments, the shielding member and the elongated plate portion of the common grounding member comprise a plurality of fork pieces which are used to clamp the shielding member and the elongated plate portion of the common grounding member and do not overlap each other in the thickness direction.

In the present disclosure, the common grounding member receiving groove is designed on one face (at least one of the first face and the second face) of the tongue. The connecting position (i.e., the first connecting position and the second connecting position) of the common grounding member and the ground terminal can be close to the contacting position of the ground terminal, and the enough strength of the configuration of the tongue can still be maintained. The contacting position of the ground terminal is positioned between the first connecting position and the second connecting position in the width direction. The projection of the contacting position of the ground terminal in the thickness direction is positioned within a range defined by the elongated plate portion of the common grounding member. The common grounding member is designed to be capable of connecting the ground terminal on the first face of the tongue and the ground terminal on the second face of the tongue together. With the above configuration, each connected ground terminal has the same potential, shorten the loop inductance of the signal and shorten the return path to improve signal integrity (SI).

Furthermore, the shielding member is designed to be detachably mechanically and electrically connected to the common grounding member and positioned between the plate-shape contact portions of two pairs of signal terminals (differential signal pairs) facing each other on the two faces, thus reduces crosstalk between the two signal terminal pairs facing each other. The shielding member can be mounted at any desired position of the common grounding member depending on the requirement of the elasticity.

The technical features and advantages of the present disclosure are widely and generally described as above, so the detailed description of the present disclosure can be better understood. Other technical features and advantages constituting the objects of the technical solutions of the present disclosure will be described below. It is to be understood by those of ordinary skill in the art that, the concept and specific embodiments disclosed below may be quite easily used to make modification or design other configuration or process to realize the same objects of the present disclosure. It is to be understood by those of ordinary skill in the art that these equivalent configurations can not depart from the spirit and scope of the present disclosure as defined by the appended technical solutions.

BRIEF DESCRIPTION OF THE DRAWINGS

Referring to the detailed description and the technical solutions in combination with the drawings, the disclosed contents of the present disclosure can be fully understood, the same reference numeral indicates the same element in the drawings.

Figure 1:
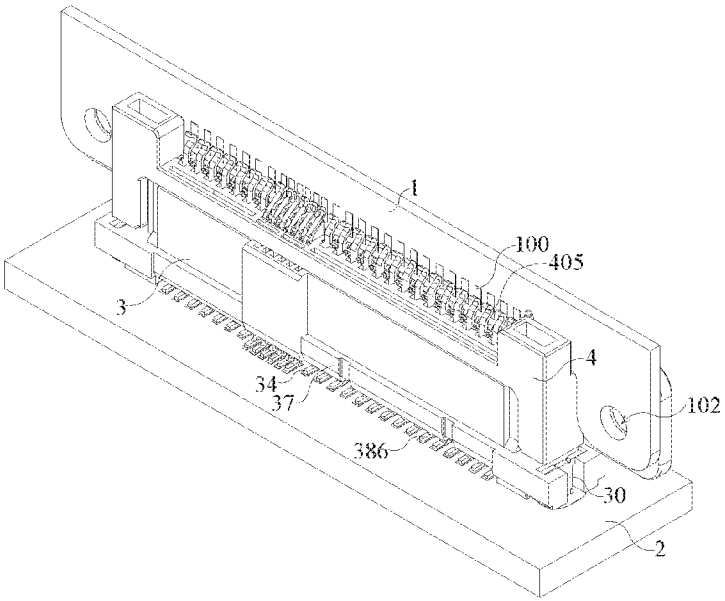
FIG. 1 is a perspective schematic view of an electrical connector and a mating connector which are assembled.

1 circuit board
2 circuit board
3 mating connector
4 electrical connector
5 tongue
7 electrical connector
30 board positioning member
31 terminal groove
32 positioning post
33 finger groove
34 mating terminal
36 common grounding member
37 housing
38 common grounding member receiving groove
40 terminal
41 housing
42 shielding member
43 fixing hole
44 common grounding member
44A common grounding member
44B common grounding member
44C common grounding member
51 first face
52 second face
53 front edge
54 rear edge
55 shielding member receiving groove
57 front edge
59 rear edge
60 contacting position
62 contacting position
64 first connecting position
66 second connecting position
70 connecting portion
100 conductive pad
102 fixing hole
200 conductive pad
202 positioning hole
204 positioning member hole
302 head
304 tail
306 interfering protrusion
340 first mating terminal
342 second mating terminal
344 mating terminal group
346 mating terminal group
348 mating terminal group
360 contacting finger
362 protrusion
364 common grounding member
366 common grounding member
368 common grounding member
370 common grounding member
372 positioning groove
386 tail portion
380 contact portion
382 elastic arm
384 fixed portion
386 tail portion
388 interfering protrusion
401A terminal group
401B terminal group
401C terminal group
402 first terminal
403 plate-shape contact portion
404 second terminal
405 tail portion
406 fixed portion
407 interfering protrusion
408 recess
409 terminal group
410 base
412 terminal receiving groove
414 protruding portion
420 fork piece
424 interfering protrusion
440 connection portion
441 elongated plate portion
442 fork piece
443 a pair of clamping arms
444 protruding portion
445 first connection portion
446 second connection portion
448 connection portion
520 common grounding member receiving groove
520A common grounding member receiving groove
520B common grounding member receiving groove
520C common grounding member receiving groove
521 hole
524 notch
525 channel
G ground terminal
G1 ground terminal
S signal terminal
S1 signal terminal
X length direction
Y width direction
Z thickness direction
D region

DETAILED DESCRIPTION

Embodiments or examples of the content of the present disclosure shown in the drawings are described in a specific language. It is to be understood that this is not intended to limit the scope of the present disclosure. Any variations or modifications of the described embodiments, as well as any further applications of the principles described herein, will normally occur to those skilled in the art. The reference numerals may be repeated in each embodiment, but even if the elements have the same reference numeral, the features in the embodiment are not necessarily used in another embodiment.

It will be understood that the various elements, assemblies, regions, layers or sections may be described herein using the terms first, second, third, etc., however, these elements, assemblies, regions, layers or sections are not limited to these terms. These terms are only used to distinguish one element, assembly, region, layer or section from another element, assembly, region, layer or section. The first element, assembly, region, layer or section described below may be referred to as a second element, assembly, region, layer or section without departing from the teachings of the inventive concept of the present disclosure.

The words used in the present disclosure are only used for the purpose of describing the specific exemplary embodiments and are not intended to limit the concept of the present disclosure. As used herein, "a" and "the" in singular are also used to contain plural, unless otherwise expressly indicated herein. It is to be understood that the word "comprise" used in the specification specifically indicates the existence of a feature, integer, step, operation, element or assembly which is described, but does not excludes the existence of one or more other features, integers, steps, operations, elements, assemblies or groups thereof.

Figure 2:
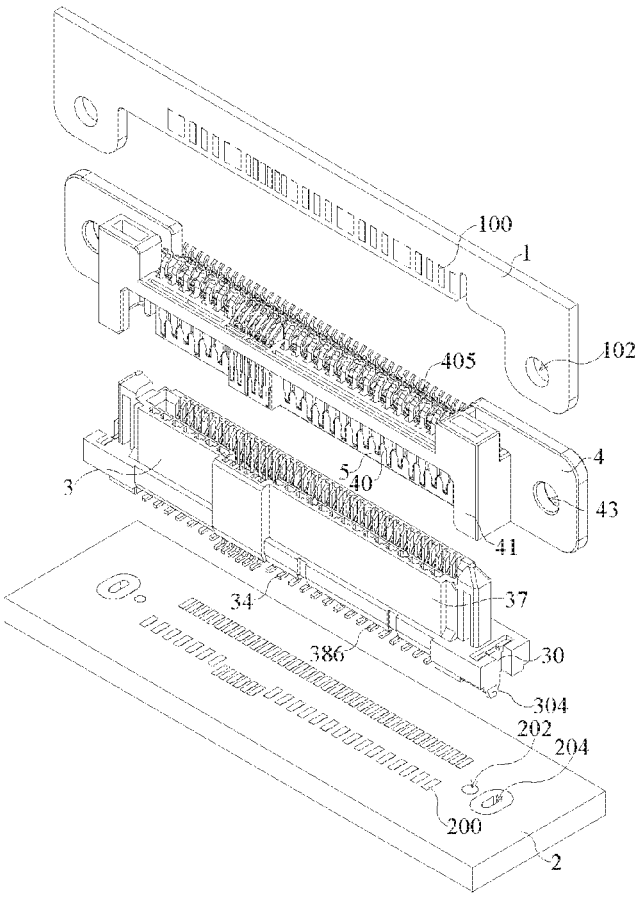
FIG. 2 is an exploded perspective schematic view of the electrical connector and the mating connector of FIG. 1.

FIG. 1 is a perspective schematic view of a mating connector 3 and an electrical connector 4 which are assembled. FIG. 2 is an exploded perspective schematic view of the electrical connector 4 and the mating connector 3 of FIG. 1. Referring to FIG. 1 and FIG. 2, the electrical connector 4 is straddle mounted on the circuit board 1. The electrical connector 4 and the circuit board 1 may be fixed together by a fixing member (not shown), such as a screw and a nut, through a fixing hole 43 of the electrical connector 4 and a fixing hole 102 of the circuit board 1. In the embodiment, the electrical connector 4 serving as a plug is inserted into the mating connector 3 serving as a receptacle. The mating connector 3 may be provided on the circuit board 2 by that a board positioning member 30 of the mating connector 3 passes through a positioning member hole 204 of a circuit board 2.

Figure 3:
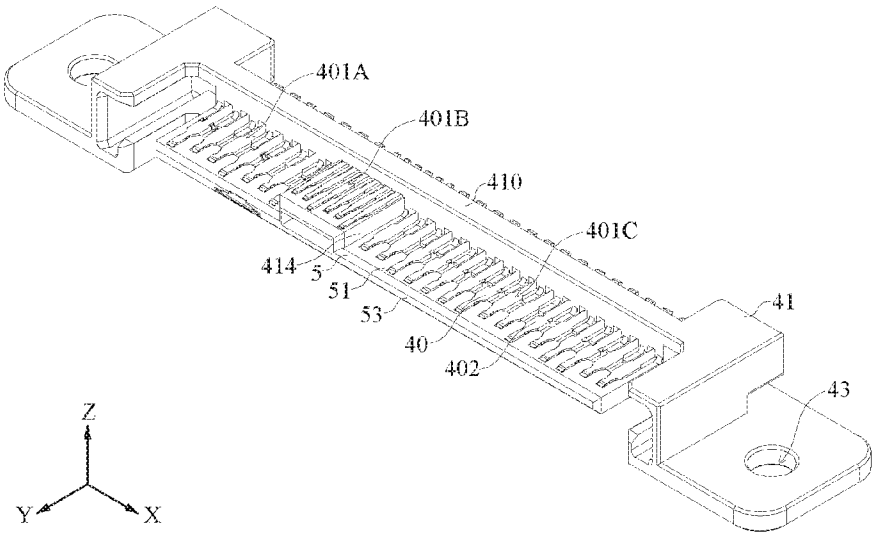
FIG. 3 is a top perspective schematic view of the electrical connector of FIG. 2
Figure 4:
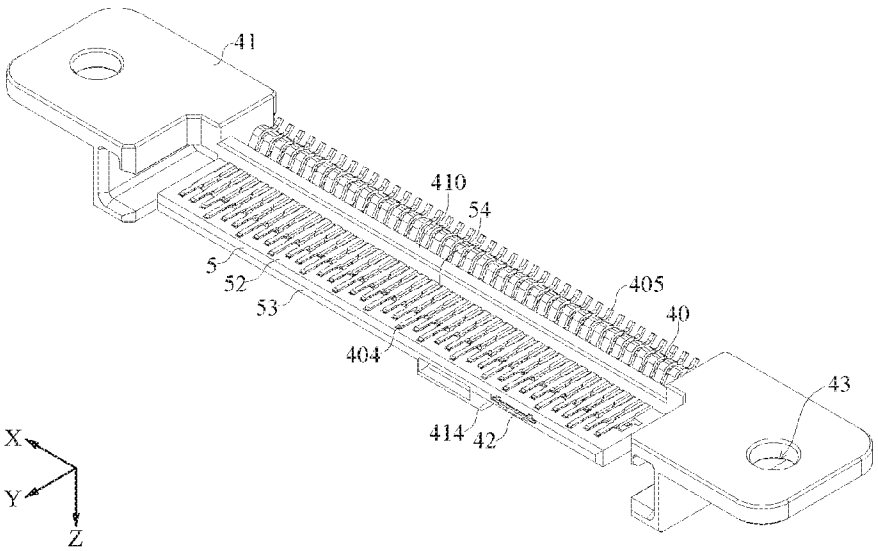
FIG. 4 is a bottom perspective schematic view of the electrical connector of FIG. 2.
Figure 5:
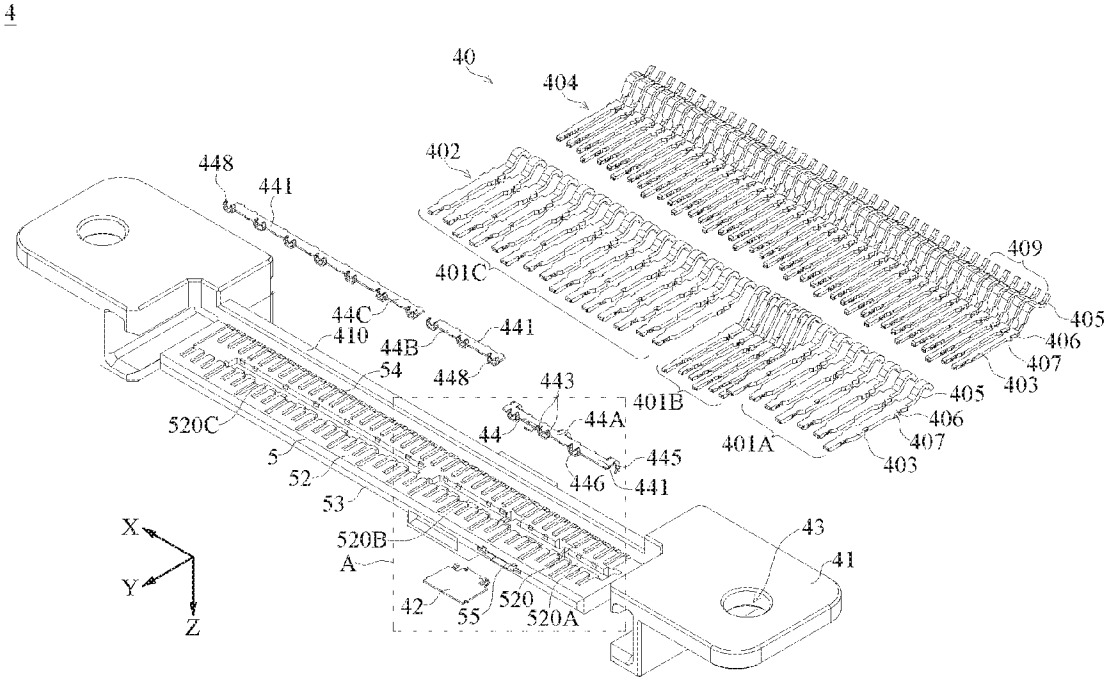
FIG. 5 is an exploded bottom perspective schematic view of the electrical connector of FIG. 4.
Figure 6:
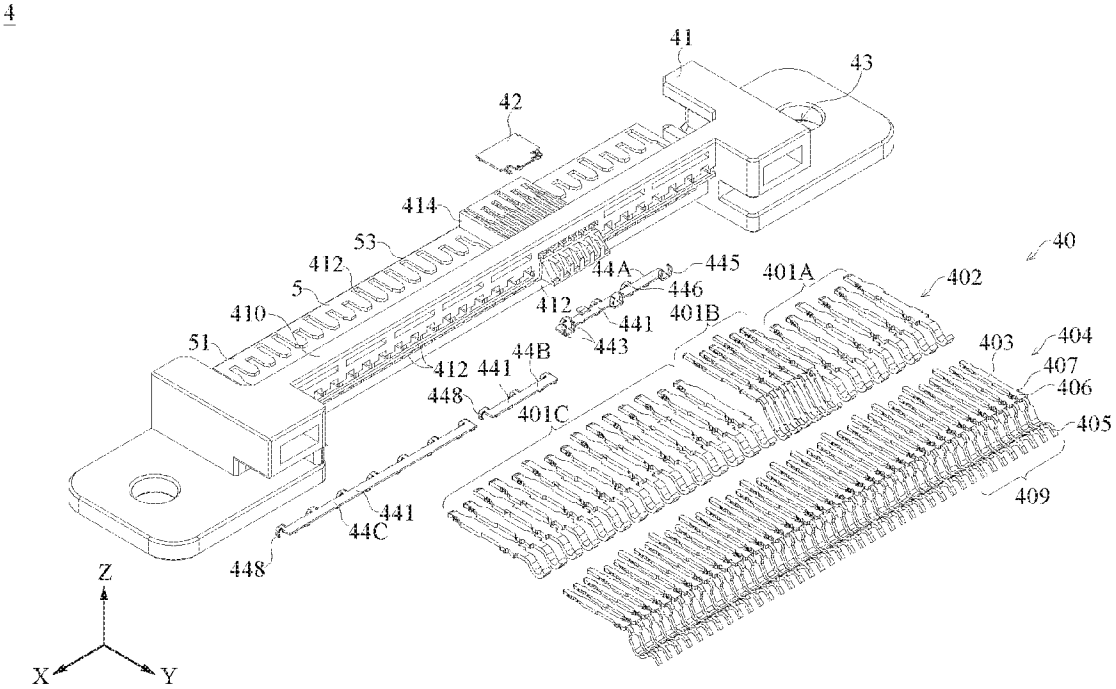
FIG. 6 is an exploded top perspective schematic view of the electrical connector of FIG. 3.
Figure 7:
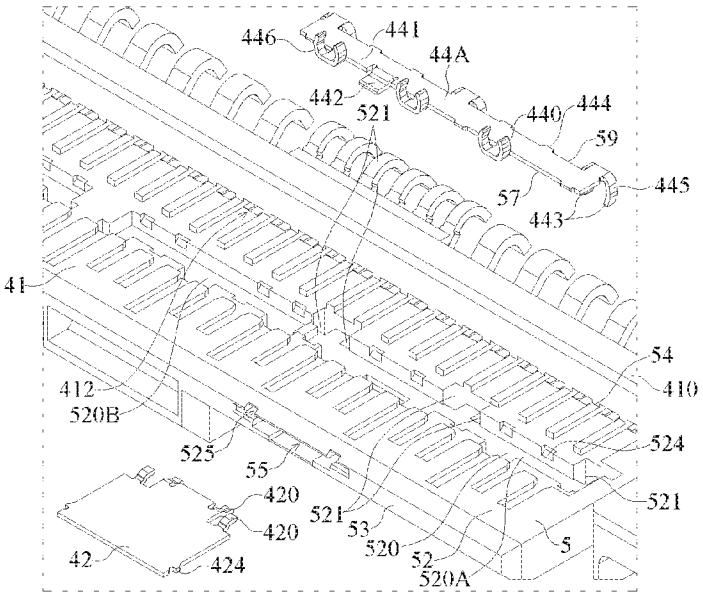
FIG. 7 is a partially enlarged perspective schematic view of FIG. 5 indicated by a region A.

FIG. 3 is a top perspective schematic view of the electrical connector 4 of FIG. 2. FIG. 4 is a bottom perspective schematic view of the electrical connector 4 of FIG. 2. FIG. 5 is an exploded bottom perspective schematic view of the electrical connector 4 of FIG. 4. FIG. 6 is an exploded top perspective schematic view of the electrical connector 4 of FIG. 3. FIG. 7 is a partially enlarged perspective schematic view of FIG. 5 indicated by a region A, in which some terminals 40 are mounted in a housing 41 of the electrical connector 4. Referring to FIG. 3 to FIG. 7, the electrical connector 4 comprises a housing 41, a plurality of terminals 40, at least one common grounding member 44 and a shielding member 42. The embodiment comprises three common grounding members 44, which are respectively common grounding members 44A, 44B and 44C.

The housing 41 comprises a base 410, a tongue 5 and a plurality of terminal receiving grooves 412. The tongue 5 comprises a first face 51 (as shown in FIG. 3) and a second face 52 (as shown in FIG. 4) which are positioned in a thickness direction Z and extend in a length direction X and a width direction Y. In addition, the tongue 5 comprises a front edge 53 and a rear edge 54 in the width direction Y, and the rear edge 54 is connected with the base 410. At least one of the first face 51 and the second face 52 of the tongue 5 is provided with at least one common grounding member receiving groove 520. In the embodiment, the second face 52 of the tongue is provided with three common grounding member receiving grooves 520, which are respectively common grounding member receiving grooves 520A, 520B and 520C. The common grounding member receiving grooves 520A, 520B and 520C correspondingly receive the common grounding members 44A, 44B and 44C respectively. Each common grounding member receiving groove 520 is recessed on the second face 52 and spaced apart from the front edge 53 and the rear edge 54 of the tongue 5 in the width direction Y, and each common grounding member 44 is mounted in each common grounding member receiving groove 520 in the thickness direction Z (in a direction from the second face 52 to the first face 51), such that each common grounding member 44 is spaced apart from the front edge 53 and the rear edge 54 of the tongue 5.

The terminal receiving grooves 412 penetrate the base 410 from rear to front and extend to surfaces of the first face 51 and the second face 52 of the tongue 5. Each terminal 40 is received in each terminal receiving groove 412 of the housing 41. Each terminal 40 comprises a plate-shape contact portion 403, a fixed portion 406 and a tail portion 405. The plate-shape contact portions 403 of the terminals 40 are arranged side by side in the length direction X. Two sides of the fixed portion 406 of each terminal 40 each comprise an interfering protrusion 407. When each terminal 40 is mounted in each terminal receiving groove 412, the interfering protrusions 407 of each terminal 40 are interfered with and fixed to inner wall faces of each terminal receiving groove 412 at the base 410, therefore, each terminal 40 is fixed in each terminal receiving groove 412. Specifically, the terminals 40 comprise a plurality of first terminals 402 of a first row and a plurality of second terminals 404 of a second row. Each first terminal 402 is provided in each terminal receiving groove 412 on the first face 51 of the tongue 5 (as shown in FIG. 3). Each second terminal 404 is provided in each terminal receiving groove 412 on the second face 52 of the tongue 5 (as shown in FIG. 4). The tail portions 405 of the first terminals 402 of the first row and the tail portions 405 of the second terminals 404 of the second row sandwich the circuit board 1 therebetween and are electrically connected with conductive pads 100 on both surfaces of the circuit board 1.

The shielding member 42 is received in a shielding member receiving groove 55 of the tongue 5. In the embodiment, the shielding member receiving groove 55 is provided at the front edge 53 of the tongue 5, extends rearwardly and is communicated with the common grounding member receiving groove 520A.

Figure 8:
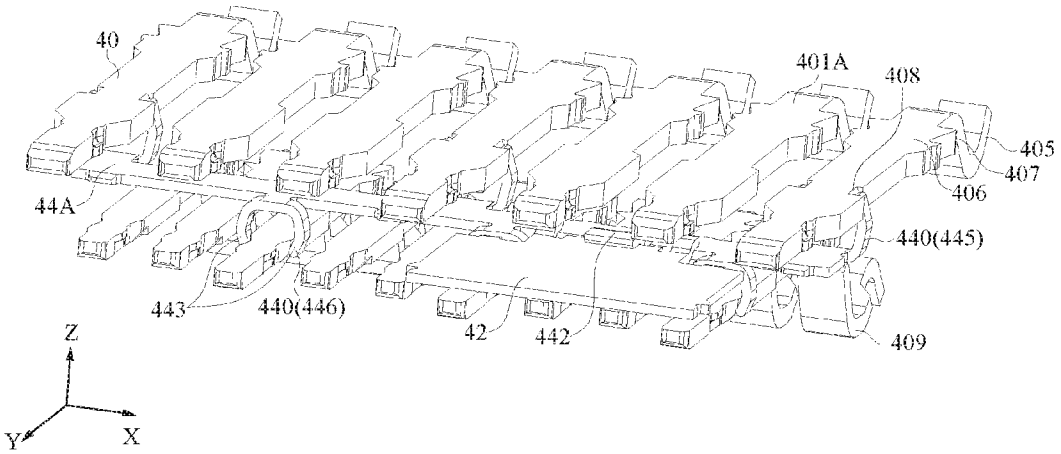
FIG. 8 is a partial perspective schematic view of the electrical connector of FIG. 3, with a housing of the electrical connector not shown.
Figure 9:
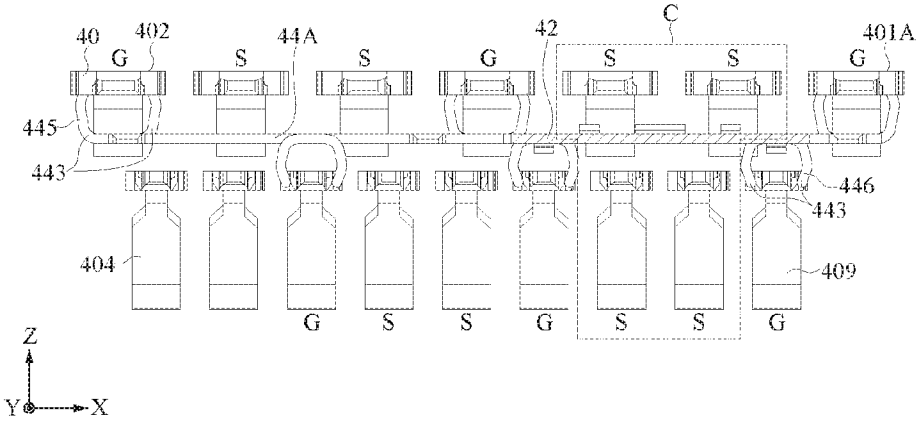
FIG. 9 is a front plan schematic view of FIG. 8.
Figure 10:
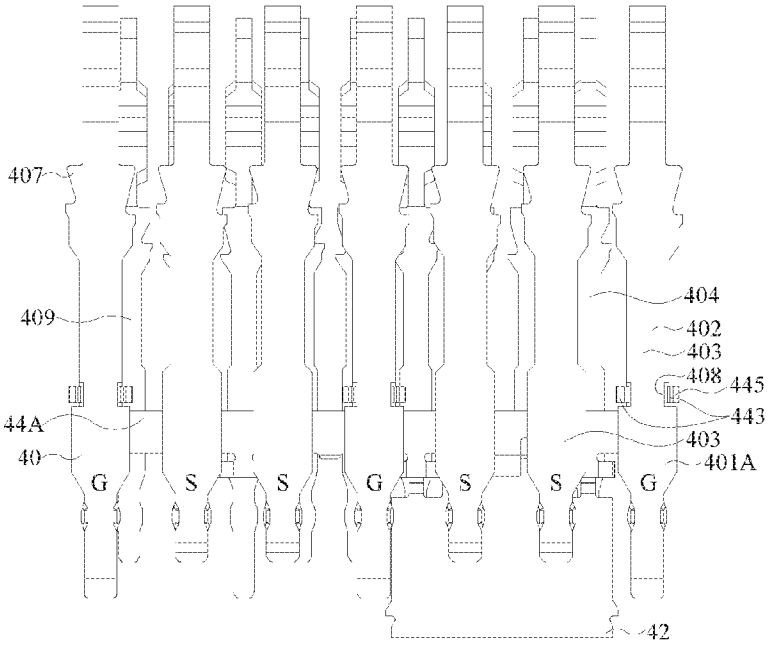
FIG. 10 is a top plan schematic view of FIG. 8.
Figure 11:
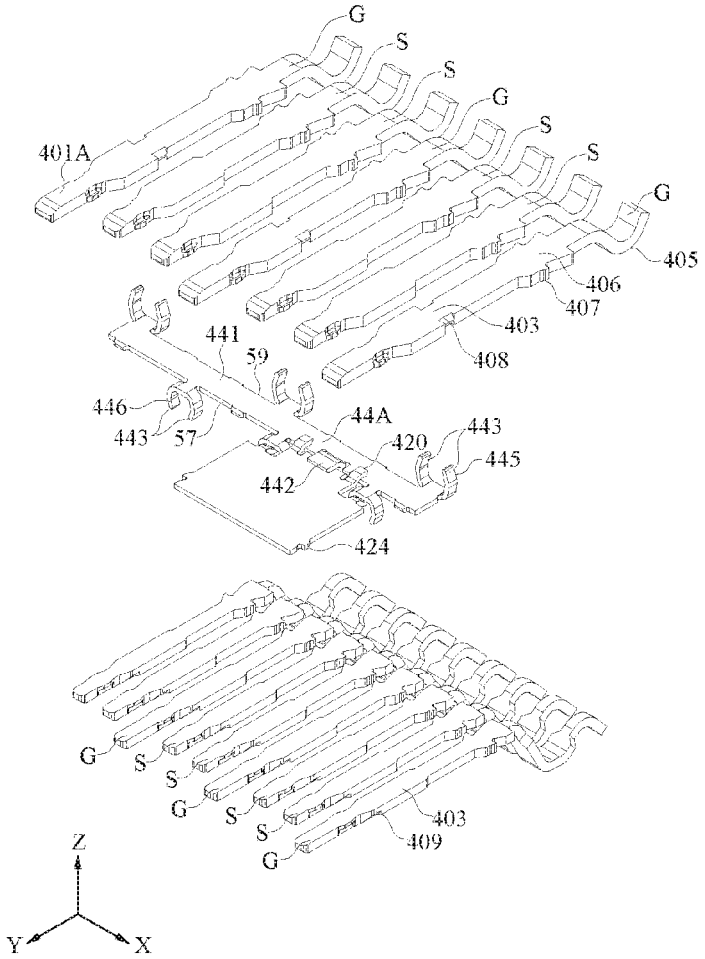
FIG. 11 is an exploded perspective schematic view of FIG. 8.

FIG. 8 is a partial perspective schematic view of the electrical connector 4 of FIG. 3, with the housing 41 not shown. FIG. 9 is a front plan schematic view of FIG. 8, wherein a portion filled with slant lines represents the shielding member 42. FIG. 10 is a top plan schematic view of FIG. 8. FIG. 11 is an exploded perspective view of FIG. 8. The first terminals 402 positioned on the first face 51 of the tongue 5 are divided into three terminal groups 401A, 401B and 401C according to distributed positions in the embodiment, in which the terminal group 401B is positioned on a protruding portion 414 (as shown in FIG. 3) of the first face 51, the terminal groups 401A and 401C are respectively positioned on both sides of the terminal group 401B in the length direction X. For the brevity and description of the drawings, the second terminals 404 corresponding to the common grounding member 44A and the terminal group 401A on the second face 52 of the tongue 5 are composed of a terminal group 409. In the illustrations shown in FIGS. 8, 9, 10, 11 and 17, only the terminal group 401A on the first face 51 and the terminal group 409 on the second face 52 which correspond to the common grounding member 44A are shown.

Referring to FIG. 8 to FIG. 11, at least some of the plurality of terminals 40 comprise signal terminals S and ground terminals G, the signal terminals S and the ground terminals G are alternately arranged. In the embodiment, as shown in FIG. 9, the first terminals 402 in the terminal group 401A comprises a signal terminal pair composed of two signal terminals S and a ground terminals G which are alternately arranged, and are sequentially arranged as a pattern GSSGSSG from the left to the right in the figures. Similarly, the second terminals 404 in the terminal group 409 comprises a signal terminal pair composed of two signal terminals S and ground terminals G which are alternately arranged. In particular, as shown in FIG. 9 indicted by a region C, a pair of signal terminals S of the terminal group 401A and a pair of signal terminals S of the terminal group 409 face each other, therefore, as shown in FIG. 9 indicated by the region C and FIG. 10, a shielding member 42 is provided between the signal terminal pair on the first face 51 and the signal terminal pair on the second face 52 which face each other, thereby reducing crosstalk between the two signal terminal pairs which face each other. However, the present disclosure is not limited thereto, and in some embodiments, the shielding member 42 can also be provided between, for example, the upper signal terminal pair and the lower signal terminal pair on the left side of the region C in FIG. 9. In other embodiments, a length of the shielding member 42 may cover between a plurality of signal terminal pairs.

Since each common grounding member 44 is mounted in each common grounding member receiving groove 520 on the second face 52 in the thickness direction Z, therefore, it can be seen from FIG. 9 and FIG. 10 that, the common grounding member 44A is positioned between the terminal group 401A and the terminal group 409 in the thickness direction Z, and positioned between the plate-shape contact portions 403 of the first terminals 402 of the terminal group 401A and the plate-shape contact portions 403 of the second terminals 404 of the terminal group 409.

Figure 12:
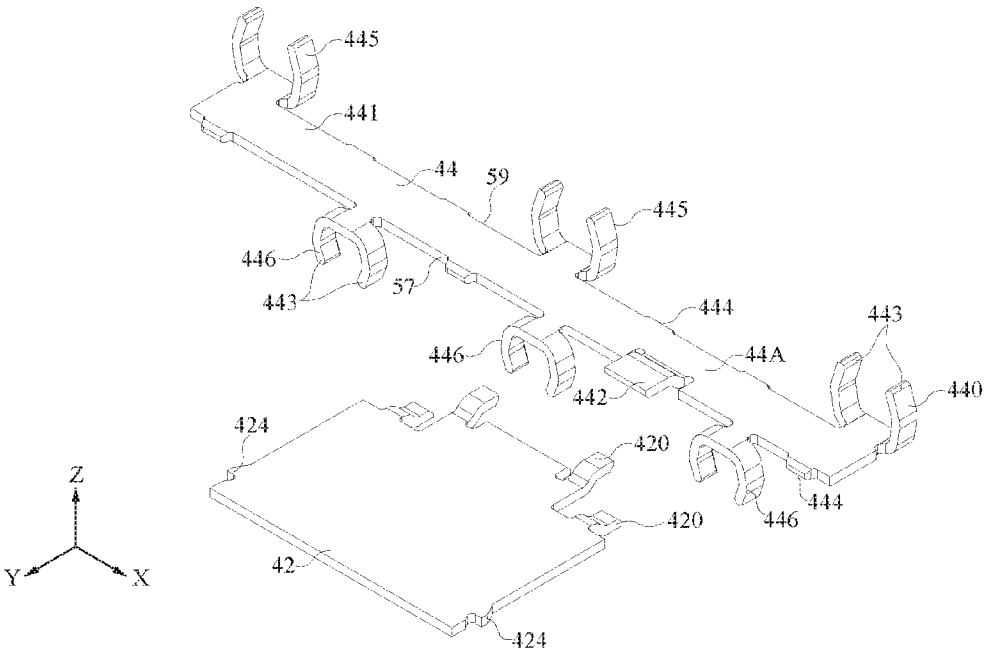
FIG. 12 is an exploded perspective schematic view of a common grounding member and a shielding member of FIG. 11.

FIG. 12 is an exploded perspective schematic view of the common grounding member 44A and the shielding member 42 of FIG. 11. Referring to FIG. 11 and FIG. 12, the common grounding member 44A comprises an elongated plate portion 441 and a plurality of connection portions 440. The elongated plate portion 441 extends in the length direction X and has a front edge 57 and a rear edge 59 in the width direction Y. Each connection portion 440 extends from the elongated plate portion 441 and extends in the thickness direction Z. Specifically, the plurality of connection portions 440 comprise a plurality of first connection portions 445 facing the first face 51 and a plurality of second connection portions 446 facing the second face 52. Each first connection portion 445 extends from the rear edge 59 of the elongated plate portion 441 in the thickness direction Z of the tongue 5 toward the first face 51 of the tongue 5 and is connected to the plate-shape contact portion 403 of each ground terminal G of the first terminals 402. Each second connection portion 446 extends from the front edge 57 of the elongated plate portion 441 in the thickness direction Z of the tongue 5 toward the second face 52 of the tongue 5 and is connected to the plate-shape contact portion 403 of each ground terminal G of the second terminals 404.

In the embodiment, each of the connection portions 440 comprises a pair of clamping arms 443 which are configured to clamp two side edges of the plate-shape contact portion 403 of the ground terminal G in the length direction X. In the embodiment, the pair of clamping arms 443 of each first connection portion 445 are configured to clamp recesses 408 of the plate-shape contact portion 403 of the ground terminal G of the terminal group 401A on both side edges in the length direction X. Accordingly, the common grounding member receiving groove 520A comprises holes 521 which allow the pair of clamping arms 443 of the first connection portion 445 to pass through the first face 51 of the tongue 5, as shown in FIG. 7. In the embodiment, the pair of clamping arms 443 of each second connection portion 446 are configured to clamp two side edges of the plate-shape contact portion 403 of the ground terminal G of the terminal group 409 in the length direction X. In the embodiment, each second terminal 404 does not have a recess 408 similar to each first terminal 402. However, the present disclosure is not limited thereto, the plate-shape contact portion 403 of each ground terminal G of the second terminals 404 can also has a recess clamped by a pair of clamping arms.

The shielding member 42 is configured to be mechanically and electrically connected to the common grounding member 44A. The shielding member 42 comprises a plurality of fork pieces 420, the plurality of fork pieces 420 extend in the thickness direction Z toward the rear edge 54 of the tongue 5 and do not overlap each other in the thickness direction Z and hold the common grounding member 44A therebetween. Returning to FIG. 7, a shielding member receiving groove 55 is provided with channels 525 which allow the fork pieces 420 of the shielding member 42 to pass through. In addition, both sides of the shielding member 42 comprise interfering protrusions 424. The interfering protrusions 424 are configured to interfere with and fixed to inner walls of the shielding member receiving groove 55, thus the shielding member 42 is fixed in the shielding member receiving groove 55.

In addition, the common grounding member 44A further comprises at least one fork piece 442. The fork piece 442 extends toward the front edge 53 of the tongue 5 in the thickness direction Z, and presses against a surface of the shielding member 42. The common grounding member 44A further comprises a plurality of protruding portions 444. Returning to FIG. 7, when the common grounding member 44A is received in the common grounding plate receiving groove 520A, the protruding portion 444 is received in a notch 524 of a housing 41.

The common grounding member 44B is similar to the common grounding member 44A in configuration, difference lies in that a length of the elongated plate portion 441 of the common grounding member 44B in the length direction X is different from a length of the elongated plate portion 441 of the common grounding member 44A. Moreover, the common grounding member 44B comprises a plurality of connection portions 448. The number of the connection portions 448 of the common grounding member 44B is different from the number of the connection portions 440 of the common grounding member 44A. In addition, all the connection portions 448 of the common grounding member 44B extend from the front edge 57 of the elongated plate portion 441 in the thickness direction Z of the tongue 5 toward the second face 52 of the tongue 5 and are respectively connected to the plate-shape contact portions 403 of the ground terminals G of the second terminals 404, therefore the common grounding member receiving groove 520B may not comprise holes as the holes 521. The common grounding member 44C and the common grounding member receiving groove 520C have similar configurations, and are not described herein again.

Figure 13:
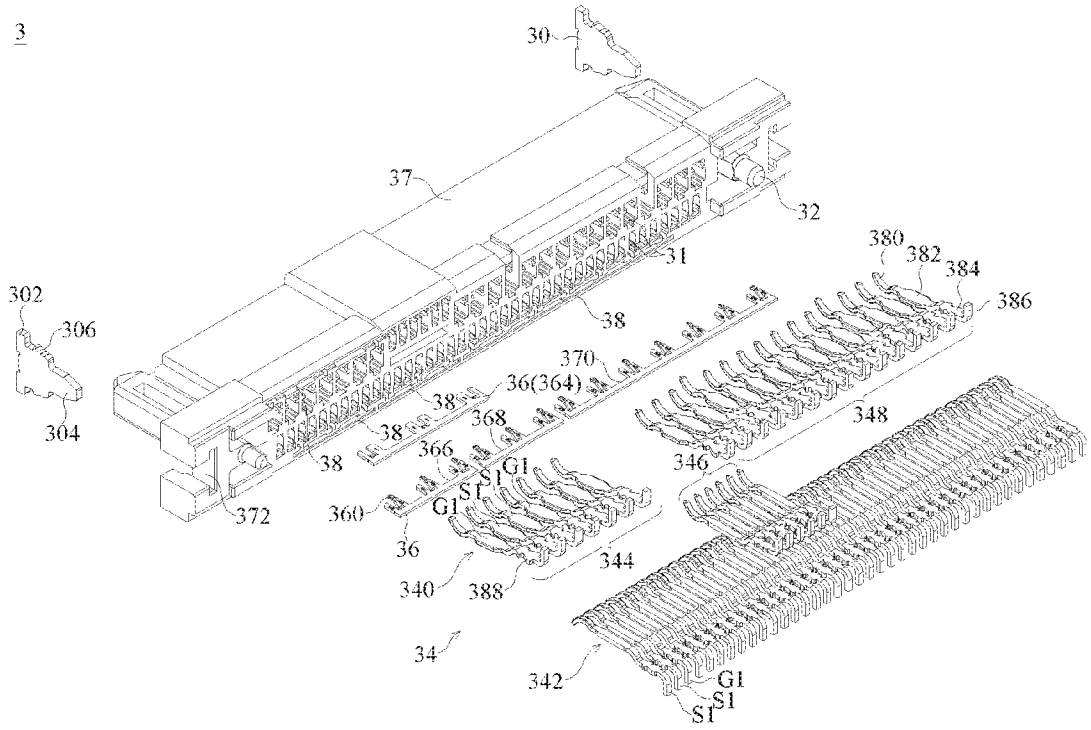
FIG. 13 is an exploded perspective schematic view of the mating connector of FIG. 2.
Figure 14:
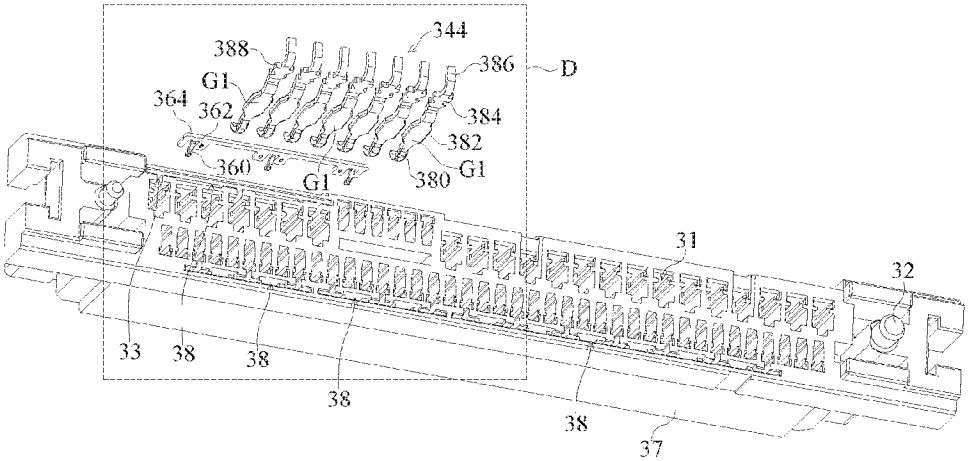
FIG. 14 is a bottom perspective schematic view of a portion of the mating connector of FIG. 13.
Figure 15:
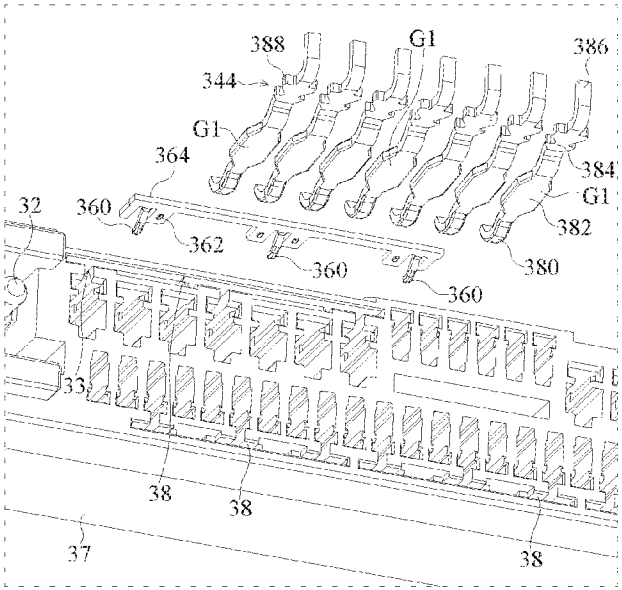
FIG. 15 is a partially enlarged perspective schematic view of FIG. 14 indicated by a region D.
Figure 16:
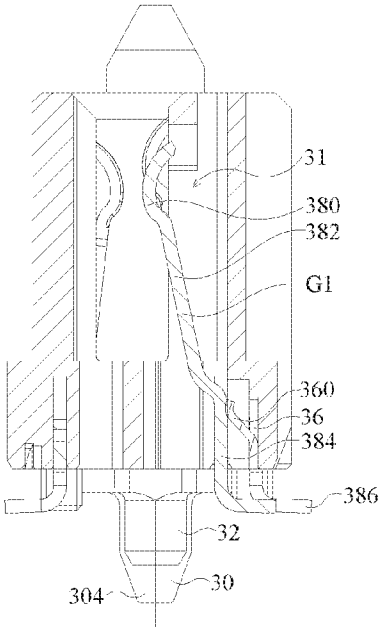
FIG. 16 is a cross sectional schematic view of the mating connector of FIG. 2.

FIG. 13 is an exploded perspective schematic view of the mating connector 3 of FIG. 2. FIG. 14 is a bottom perspective schematic view of a portion of the mating connector 3 of FIG. 13. FIG. 15 is a partially enlarged perspective schematic view of FIG. 14 indicated by a region D. FIG. 16 is a cross sectional schematic view of the mating connector 3 of FIG. 2. Referring to FIG. 13 to FIG. 16, the mating connector 3 comprises a housing 37, a plurality of mating terminals 34 and a plurality of common grounding members 36. The embodiment comprises four common grounding members 36, which respectively are common grounding members 364, 366, 368 and 370.

The mating terminals 34 are received in a plurality of terminal grooves 31 of the housing 37 respectively. The mating terminals 34 comprise signal terminals S1 and ground terminals G1, the signal terminals S1 and the ground terminals G1 are alternately arranged. Specifically, the mating terminals 34 comprise a plurality of first mating terminals 340 of a first row and a plurality of second mating terminals 342 of a second row. The first mating terminals 340 in the embodiment are divided into three mating terminal groups 344, 346 and 348 according to distributed positions. For brevity and illustration of the drawings, in the illustration shown in FIG. 14 and FIG. 15, only the common grounding member 366 and the mating terminal group 344 corresponding to the common grounding member 366 are shown.

Each mating terminal 34 comprises a contact portion 380, an elastic arm 382, a fixed portion 384 and a tail portion 386. As shown in FIG. 1 and FIG. 2, the tail portion 386 extends out of a bottom face of the housing 37. In some embodiments, the tail portion 386 comprises a surface mounting technology (SMT) tail portion, the SMT tail portion 386 is soldered to a conductive pad 200 of the circuit board 2 so as to fix the mating terminal 34 on the circuit board 2, and in turn the mating terminal 34 is electrically connected with the conductive pad 200 of the circuit board 2. The fixed portion 384 of each ground terminal G1 of the mating terminals 34 is mechanically and electrically contacted by a contacting finger 360 of the common grounding member 36. Accordingly, the ground terminals G1 of the mating terminals 34 which contact the same common grounding member 36 are electrically connected with each other, and have the same grounding potential. As shown in FIG. 14 to FIG. 16, taking the mating terminal group 344 as an example, the fixed portion 384 of each ground terminals G1 of the first mating terminals 340 of the mating terminal group 344 is mechanically and electrically contacted by each contacting finger 360 of the common grounding member 364. Accordingly, the ground terminals G1 of the first mating terminals 340 of the mating terminal group 344 are electrically connected with each other, and have the same grounding potential. The common grounding members 366, 368 and 370 are similar to the common grounding member 364 in configuration, difference lies in lengths in the length direction X and the number of the contacting fingers 360. In addition, because the contacting fingers 360 of each of the common grounding members 364, 366, 368 and 370 are arranged on the outer side of each of the mating terminals 34 and contact the fixed portion 384 of the ground terminal G1 with only a single extension, therefore the mating connector 3 has more common grounding members than the electrical connector 4.

In addition, two sides of the fixed portion 384 of the mating terminal 34 each comprise an interfering protrusion 388. When the mating terminal 34 is mounted in the terminal groove 31, the interfering protrusions 388 of the mating terminal 34 are interfered with and fixed with inner wall face of the terminal groove 31. Accordingly, the mating terminal 34 are better fixed in the terminal groove 31.

The common grounding member 364 is received in a common grounding member receiving groove 38 of the housing 37. A through groove 33 is provided between the common grounding member receiving groove 38 and the terminal groove 31 to which the ground terminal G1 is mounted such that the contacting finger 360 of the common grounding member 364 passes through the through groove 33 to contact the ground terminal G1. Similarly, the housing 37 further comprises common grounding member receiving grooves which receive the common grounding members 366, 368 and 370 respectively. These common grounding member receiving grooves may be similar to the common grounding member receiving groove 38 in configuration, and are not described herein again.

The common grounding member 364 further comprises a plurality of protrusions 362. The protrusion 362 is configured to interfere with an inner wall face of the common grounding member receiving groove 38. Accordingly, the common grounding member 364 is better held in the common grounding member receiving groove 38.

The board positioning member 30 comprises a head 302, a tail 304 and two interfering protrusions 306. The head 302, for example a T-shaped head, is fitted on an upper end of a positioning groove 372 (shown in FIG. 13) of the housing 37. The interfering protrusion 306 of the board positioning member 30 interferes with a wall face of the positioning groove 372 to fix the board positioning member 30, and the tail 304 of the board positioning member 30 extend out of a bottom face to protrude from the housing 37 of the positioning groove 372. When the mating connector 3 is mounted on the circuit board 2, a positioning post 32 of the housing 37 is positioned in a positioning hole 202 on the circuit board 2, and the tail 304 of the board positioning member 30 is inserted into the positioning member hole 204 on the circuit board 2.

Figure 17:
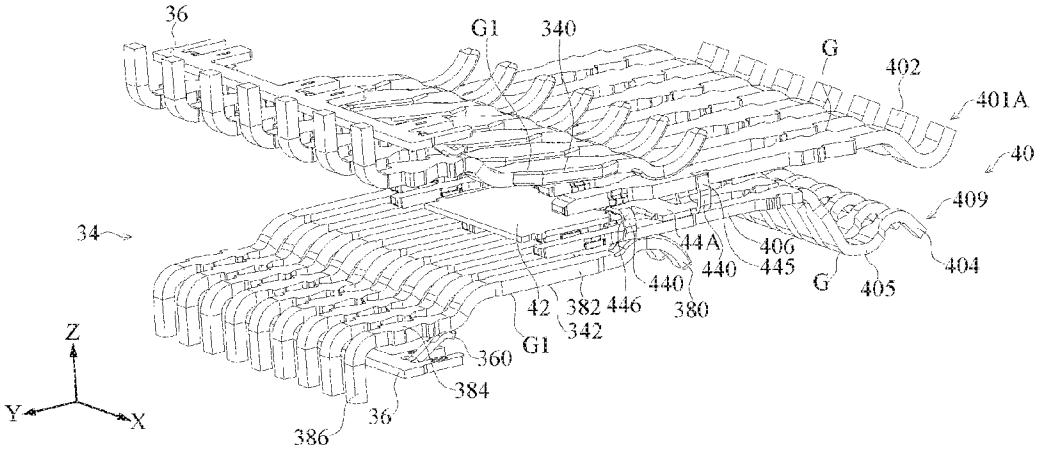
FIG. 17 is a partial perspective schematic view of the electrical connector and the mating connector of FIG. 1, with the housing of the electrical connector and the housing of the mating connector not shown.
Figure 18:
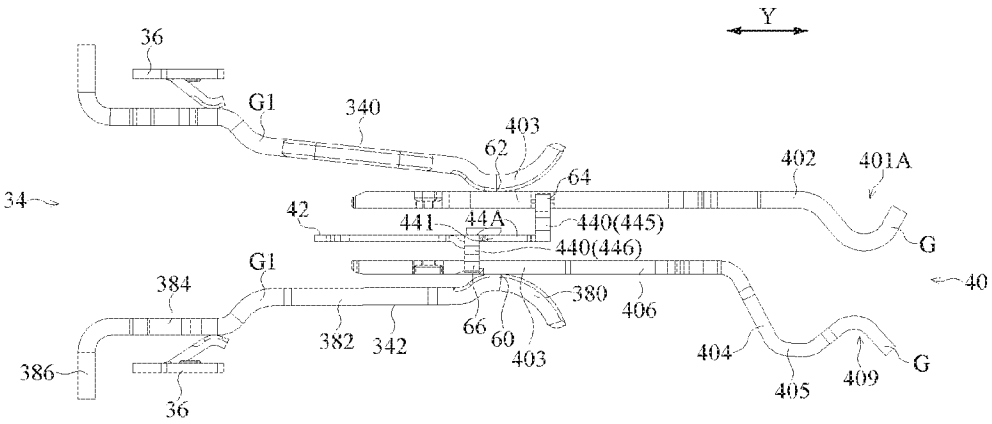
FIG. 18 is a side plan schematic view of FIG. 17.

FIG. 17 is a partial perspective schematic view of the electrical connector 4 and the mating connector 3 of FIG. 1, with the housing 41 of the electrical connector 4 and the housing 37 of the mating connector 3 not shown. FIG. 18 is a side plan schematic view of FIG. 17. Referring to FIG. 17 and FIG. 18, each first connection portion 445 of the common grounding member 44A is connected with the plate-shape contact portion 403 of each ground terminal G of the first terminals 402 of the terminal group 401A at a first connecting position 64; each second connection portion 446 of the common grounding member 44A is connected with the plate-shape contact portion 403 of each ground terminal G of the second terminals 404 of the terminal group 409 at a second connecting position 66. A contacting position 62 where each ground terminal G of the first terminals 402 of the terminal group 401A is mated with the ground terminal G1 of the first mating terminals 340 is positioned between the first connecting position 64 and the second connecting position 66 in the width direction Y; similarly, a contacting position 60 where each ground terminal G of the second terminals 404 of the terminal group 409 is mated with the ground terminal G1 of the second mating terminals 342 is positioned between the first connecting position 64 and the second connecting position 66 in the width direction Y. Furthermore, projections of the contacting positions 60 and 62 of two ground terminals G in the thickness direction Z to be mated are positioned within a range defined by the elongated plate portion 441 of the common grounding member 44A. Accordingly, it is possible to shorten the loop inductance of the signal and shorten the return path to improve signal integrity (SI).

Figure 19:
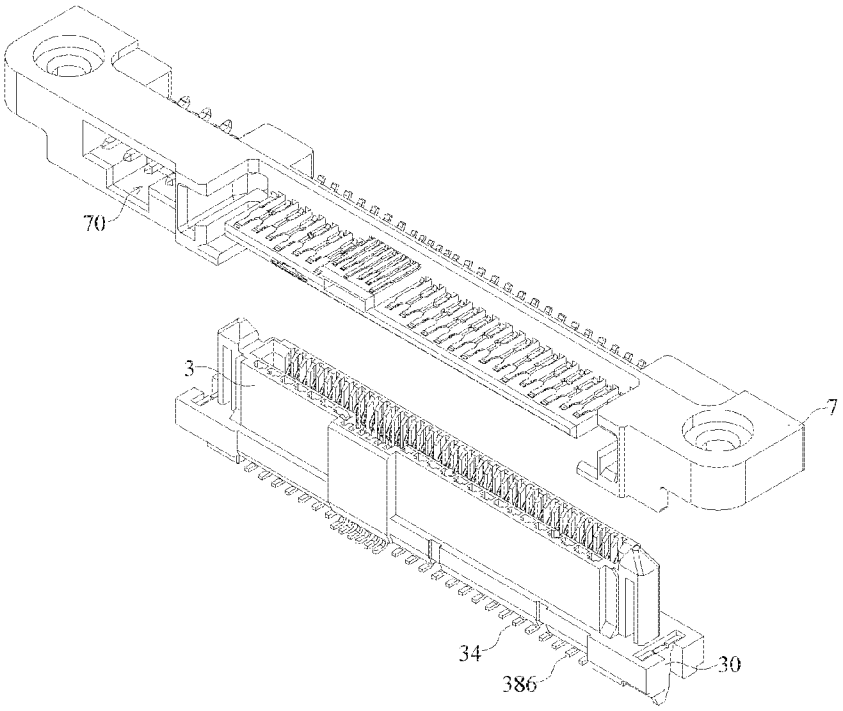
FIG. 19 is a perspective schematic view of another embodiment of the electrical connector, and reference numerals in FIGS. 1-19 are represented as follows.

FIG. 19 is a perspective view of another embodiment of an electrical connector 7. Referring to FIG. 19, the electrical connector 7 is similar to the electrical connector 4 as shown in FIG. 3, difference lies in that the electrical connector 7 further comprises, for example, a connecting portion 70. In an embodiment, the connecting portion 70 comprises a power supply portion for transmitting electrical energy.

While the present disclosure and its advantages are described in detail, it is understood that various changes, replacements and substitutions may be made without departing from the spirit and scope of the present disclosure defined by the technical solutions. For example, many processes described above can be implemented in a variety of ways, and many processes described above can be replaced with other processes or combinations thereof.

Further, the scope of the present disclosure is not limited to the specific embodiments of process, machinery, manufacturing, substance composition, means, method or step described in the specification. Those skilled in the art can understand from the disclosed contents of the present disclosure that existing or future developed process, machinery, manufacturing, substance composition, means, method or step which has the same function or achieve essentially the same result as the corresponding embodiment described herein can be used in accordance with the present disclosure. Accordingly, such a process, machinery, manufacturing, substance composition, mean, method or step is included in the technical solution of the present disclosure.

The invention claimed is:

1. An electrical connector, comprising:

a housing comprising:

a base; and a tongue comprising a first face and a second face which are positioned at a thickness direction and extend in a length direction and a width direction, the tongue comprising a front edge and a rear edge in the width direction, and the rear edge connecting the base;

a plurality of terminals, each terminal having a plate-shape contact portion, at least some of the plurality of terminals comprising signal terminals and ground terminals, the plurality of terminals comprising:

a plurality of first terminals, a plate-shape contact portion of each first terminal being provided on the first face of the tongue; and a plurality of second terminals, a plate-shape contact portion of each second terminal being provided on the second face of the tongue; and at least one common grounding member which is spaced from the front edge and the rear edge of the tongue and mounted on the tongue in the thickness direction, and positioned between the plate-shape contact portion of the first terminal and the plate-shape contact portion of the second terminal, the common grounding member comprising:

an elongated plate portion extending in the length direction; and a plurality of connection portions extending from the elongated plate portion in the thickness direction and connected to the plate-shape contact portion of the corresponding ground terminal.

2. The electrical connector according to claim 1, wherein at least one of the first face and the second face of the tongue is provided with a common grounding member receiving groove receiving the common grounding member.

3. The electrical connector according to claim 2, wherein each connection portion comprises:

a pair of clamping arms configured to clamp two side edges of the plate-shape contact portion of the ground terminal in the length direction.

4. The electrical connector according to claim 2, wherein the at least some of the plurality of terminals further comprise a signal terminal pair, the signal terminal pair and the ground terminals are alternately arranged, and the electrical connector further comprises:

a shielding member configured to be mechanically and electrically connected to the common grounding member and positioned between the plate-shape contact portions of the signal terminal pair provided on the first face of the tongue and the plate-shape contact portions of the signal terminal pair provided on the second face of the tongue.

5. The electrical connector according to claim 4, wherein the tongue further comprises:

a shielding member receiving groove which is provided at the front edge of the tongue, extends rearwardly and is communicated with the common grounding member receiving groove.

6. The electrical connector according to claim 5, wherein the shielding member and the elongated plate portion of the common grounding member comprise a plurality of fork pieces which are used to clamp the shielding member and the elongated plate portion of the common grounding member and do not overlap each other in the thickness direction.

7. An electrical connector, comprising:

a housing comprising:

a base; and a tongue comprising a first face and a second face which are positioned in a thickness direction and extend in a length direction and a width direction, the tongue comprising a front edge and a rear edge in the width direction, and the rear edge connecting the base;

a plurality of terminals, each terminal having a plate-shape contact portion, at least some of the plurality of terminals comprising signal terminals and ground terminals, the plurality of terminals comprising:

a plurality of first terminals provided on the first face of the tongue; and a plurality of second terminals provided on the second face of the tongue; and at least one common grounding member which is mounted on the tongue and positioned between the plate-shape contact portion of the first terminal and the plate-shape contact portion of the second terminal, the common grounding member comprising:

an elongated plate portion extending in the length direction;

a plurality of first connection portions which each extend from the elongated plate portion toward the first face of the tongue and each are connected to the plate-shape contact portion of the ground terminal of the first terminals at a first connecting position; and a plurality of second connection portions which each extend from the elongated plate portion toward the second face of the tongue and each are connected to the plate-shape contact portion of the ground terminal of the second terminals at a second connecting position;

a contacting position of each ground terminal to be mated being positioned between the first connecting position and the second connecting position in the width direction.

8. The electrical connector according to claim 7, wherein the common grounding member is spaced apart from the front edge and the rear edge of the tongue and mounted on the tongue in the thickness direction.

9. The electrical connector according to claim 8, wherein the second face of the tongue is provided with a common grounding member receiving groove receiving the common grounding member.

10. The electrical connector according to claim 9, wherein a projection of the contacting position of the ground terminal in the thickness direction to be mated is positioned within a range defined the elongated plate portion of the common grounding member.

11. The electrical connector according to claim 10, wherein the first connection portion and the second connection portion each comprise a pair of clamping arms, the pair of clamping arms are configured to clamp two side edges of the plate-shape contact portion of the ground terminal in the length direction.

12. The electrical connector according to claim 11, wherein the common grounding member receiving groove comprises a hole for the pair of clamping arms of the first connection portion to pass through the first face of the tongue.

13. The electrical connector according to claim 9, wherein the at least some of the plurality of terminals further comprise a signal terminal pair, the signal terminal pair and the ground terminals are alternately arranged, and the electrical connector further comprises:

a shielding member configured to be mechanically and electrically connected to the common grounding member and positioned between the plate-shape contact portions of the signal terminal pair provided on the first face of the tongue and the plate-shape contact portions of the signal terminal pair provided on the second face of the tongue.

14. The electrical connector according to claim 13, wherein the tongue further comprises:

a shielding member receiving groove which is provided at the front edge of the tongue, extends rearwardly and is communicated with the common grounding member receiving groove.

15. The electrical connector according to claim 14, wherein the shielding member and the elongated plate portion of the common grounding member comprise a plurality of fork pieces which are used to clamp the shielding member and the elongated plate portion of the common grounding member and do not overlap each other in the thickness direction.

* * * * *